US010586644B2

(12) United States Patent
Tsukada et al.

(10) Patent No.: US 10,586,644 B2
(45) Date of Patent: Mar. 10, 2020

(54) REACTOR, MOTOR DRIVER, POWER CONDITIONER, AND MACHINE

(71) Applicant: FANUC CORPORATION, Yamanashi (JP)

(72) Inventors: Kenichi Tsukada, Yamanashi (JP); Masatomo Shirouzu, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 0 days.

(21) Appl. No.: 15/907,477

(22) Filed: Feb. 28, 2018

(65) Prior Publication Data

US 2018/0254135 A1 Sep. 6, 2018

(30) Foreign Application Priority Data

Mar. 3, 2017 (JP) ..... 2017-040399

(51) Int. Cl.

| | |
|---|---|
| ***H01F 27/02*** | (2006.01) |
| ***H01F 27/32*** | (2006.01) |
| ***H01F 37/00*** | (2006.01) |
| ***H01F 27/24*** | (2006.01) |
| ***H01F 27/29*** | (2006.01) |
| ***H01F 27/34*** | (2006.01) |

(52) U.S. Cl.

CPC ..... *H01F 27/025* (2013.01); *H01F 27/24* (2013.01); *H01F 27/29* (2013.01); *H01F 27/32* (2013.01); *H01F 27/34* (2013.01); *H01F 37/00* (2013.01)

(58) Field of Classification Search

USPC ..... 336/59

See application file for complete search history.

(56) References Cited

U.S. PATENT DOCUMENTS

| | | | | |
|---|---|---|---|---|
| 9,768,723 | B2 | 9/2017 | Sakai et al. | |
| 2006/0279393 | A1* | 12/2006 | Shudarek | H01F 27/263 336/198 |
| 2009/0115551 | A1* | 5/2009 | Kobayashi | H01F 17/045 333/185 |
| 2009/0261939 | A1* | 10/2009 | Shudarek | H01F 3/10 336/212 |
| 2011/0115417 | A1 | 5/2011 | Shimada | |
| 2014/0091891 | A1* | 4/2014 | Metzler | H01F 27/29 336/192 |
| 2014/0203901 | A1 | 7/2014 | Chamura et al. | |

(Continued)

FOREIGN PATENT DOCUMENTS

| | | | |
|---|---|---|---|
| DE | 112008003921 | T5 | 6/2011 |
| DE | 102016101473 | A1 | 8/2016 |
| JP | S50139547 | U | 11/1975 |

(Continued)

*Primary Examiner* — Elvin G Enad
*Assistant Examiner* — Kazi S Hossain
(74) *Attorney, Agent, or Firm* — RatnerPrestia

(57) ABSTRACT

An operator is prevented from touching terminals and the like. A reactor includes an outer peripheral iron core, and at least three core coils disposed inside the outer peripheral iron core. Each of the core coils includes a core and a coil wound onto the core. The reactor further includes a terminal base that has a plurality of terminals connected to leads extending from the coils and is disposed on one end of the outer peripheral iron core, and an electric shock prevention cover for covering the terminals of the terminal base.

13 Claims, 14 Drawing Sheets

(56) References Cited

U.S. PATENT DOCUMENTS

2016/0125998 A1* 5/2016 Bhide ..... H01F 37/00
336/5

FOREIGN PATENT DOCUMENTS

| | | | |
|---|---|---|---|
| JP | S52072851 | U | 5/1977 |
| JP | S58034719 | U | 3/1983 |
| JP | H06042328 | Y | 11/1994 |
| JP | 2000223319 | A | 8/2000 |
| JP | 2009283706 | A | 12/2009 |
| JP | 2010045111 | A | 2/2010 |
| JP | 2010252539 | A | 11/2010 |
| JP | 2011254005 | A | 12/2011 |
| JP | 2012022940 | A | 2/2012 |
| JP | 2012033711 | A | 2/2012 |
| WO | 2010119324 | A2 | 10/2010 |

* cited by examiner

REACTOR, MOTOR DRIVER, POWER CONDITIONER, AND MACHINE

CROSS-REFERENCE TO RELATED APPLICATIONS

This application is a new U.S. Patent Application that claims benefit of Japanese Patent Application No. 2017-040399, filed Mar. 3, 2017, the disclosure of this application is being incorporated herein by reference in its entirety for all purposes.

BACKGROUND OF THE INVENTION

1. Field of the Invention

The present invention relates to a reactor, a motor driver, a power conditioner, and a machine.

2. Description of Related Art

In general, reactors each have a plurality of cores and a plurality of coils wound onto the cores. The reactors have a problem that leakage magnetic flux penetrates through adjacent coils and generates eddy current in the coils, thus resulting in an increase in the temperature of the coils. Therefore, a technique for dissipating heat of the reactor using a heat sink or a heat slinger is known. For example, refer to Japanese Unexamined Patent Publication (Kokai) No. 2009-283706.

SUMMARY OF THE INVENTION

A terminal base is disposed on an outer peripheral iron core, and coils are connected to terminals of the terminal base. Thus, an operator may be at risk of touching the terminals and the like of the terminal base.

Therefore, it is desired to provide a reactor that can prevent an operator from touching terminals and the like, and to provide a motor driver, a power conditioner, and a machine having the reactor.

A first embodiment of this disclosure provides a reactor that includes an outer peripheral iron core, and at least three core coils disposed inside the outer peripheral iron core. Each of the core coils includes a core and a coil wound onto the core. The reactor further includes a terminal base that has a plurality of terminals connected to leads extending from the coils and which is disposed on one end of the outer peripheral iron core, and an electric shock prevention cover for covering the terminals of the terminal base.

According to the first embodiment, the cover attached to the terminal base prevents an operator from touching the terminals, thus ensuring the safety of the operator.

The above objects, features and advantages and other objects, features and advantages of the present invention will become more apparent from the following detailed description of preferred embodiments along with the accompanying drawings.

DETAILED DESCRIPTION OF THE INVENTION

Figure 1:
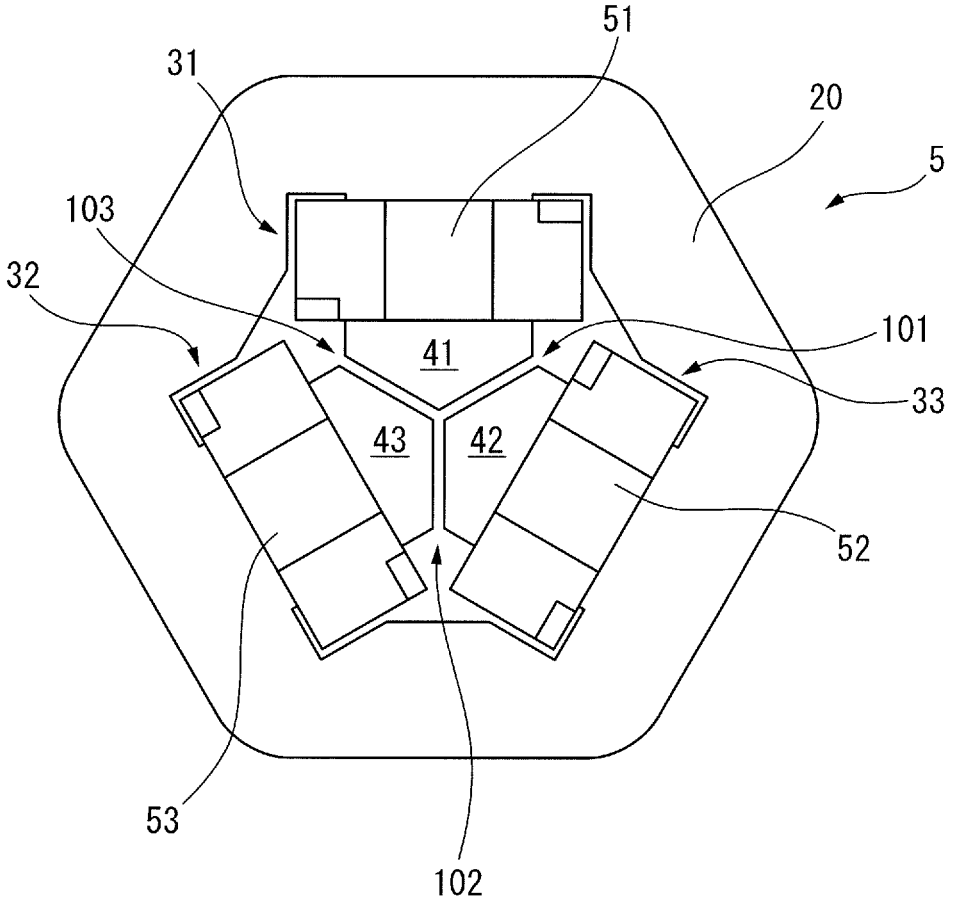
FIG. 1 is an end view of a reactor according to a first embodiment.

Embodiments of the present invention will be described below with reference to the accompanying drawings. In the drawings, the same reference numerals indicate the same components. For ease of understanding, the drawing scales are modified in an appropriate manner.

FIG. 1 is an end view of a reactor according to a first embodiment. As shown in FIG. 1, a reactor 5 includes an outer peripheral iron core 20 having a hexagonal cross-section and at least three core coils 31 to 33 disposed inside the outer peripheral iron core 20. The number of cores is preferably an integral multiple of 3, and the reactor 5 can thereby be used as a three-phase reactor. Note that, the outer peripheral iron core 20 may be another polygonal shape or round.

The core coils 31 to 33 include cores 41 to 43 and coils 51 to 53 wound onto the cores 41 to 43, respectively. Each of the outer peripheral iron core 20 and the cores 41 to 43 is made by stacking iron sheets, carbon steel sheets or electromagnetic steel sheets, or made of a pressed powder core.

As shown in FIG. 1, the cores 41 to 43 have approximately the same dimensions as each other, and are arranged at approximately equal intervals in the circumferential direction of the outer peripheral iron core 20. In FIG. 1, the cores 41 to 43 are in contact or integral with the outer peripheral iron core 20 at their radial outer end portions.

Furthermore, the cores 41 to 43 converge toward the center of the outer peripheral iron core 20 at their radial inner end portions each having an edge angle of approximately 120°. The radial inner end portions of the cores 41 to 43 are separated from each other by gaps 101 to 103, which can be magnetically coupled.

In other words, in the first embodiment, the radial inner end portion of the core 41 is separated from the radial inner end portions of the two adjacent cores 42 and 43 by the gaps 101 and 103, respectively. The same is true for the other cores 42 and 43. Note that, the gaps 101 to 103 ideally have the same dimensions, but may have different dimensions. In embodiments described later, a description regarding the gaps 101 to 103, the core coils 31 to 33, and the like may be omitted.

As described above, in the first embodiment, the core coils 31 to 33 are disposed inside the outer peripheral iron core 20. In other words, the core coils 31 to 33 are enclosed with the outer peripheral iron core 20. The outer peripheral iron core 20 can reduce leakage of magnetic flux generated by the coils 51 to 53 to the outside.

Figure 2A:
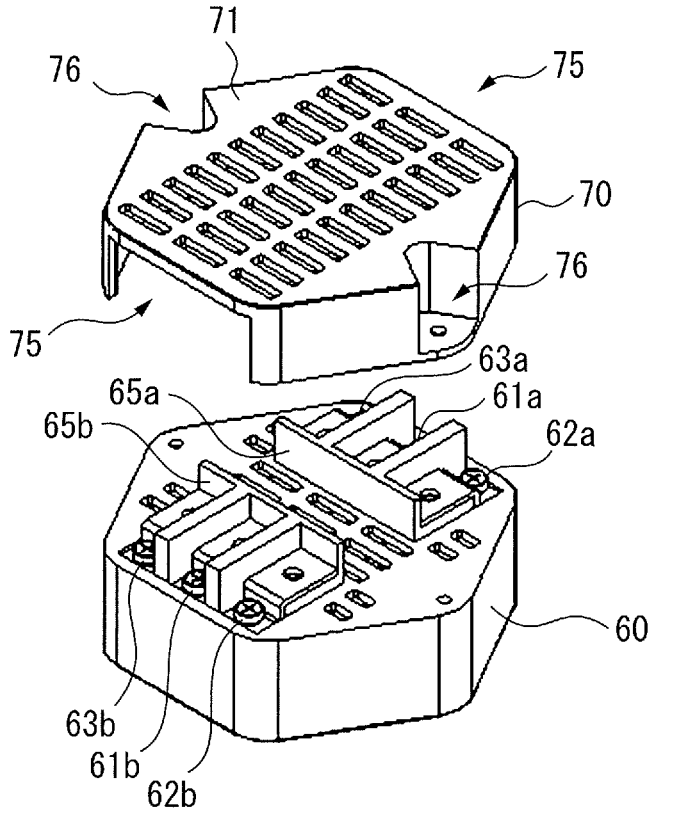
FIG. 2A is an exploded perspective view of the reactor shown in FIG. 1.
Figure 2A:
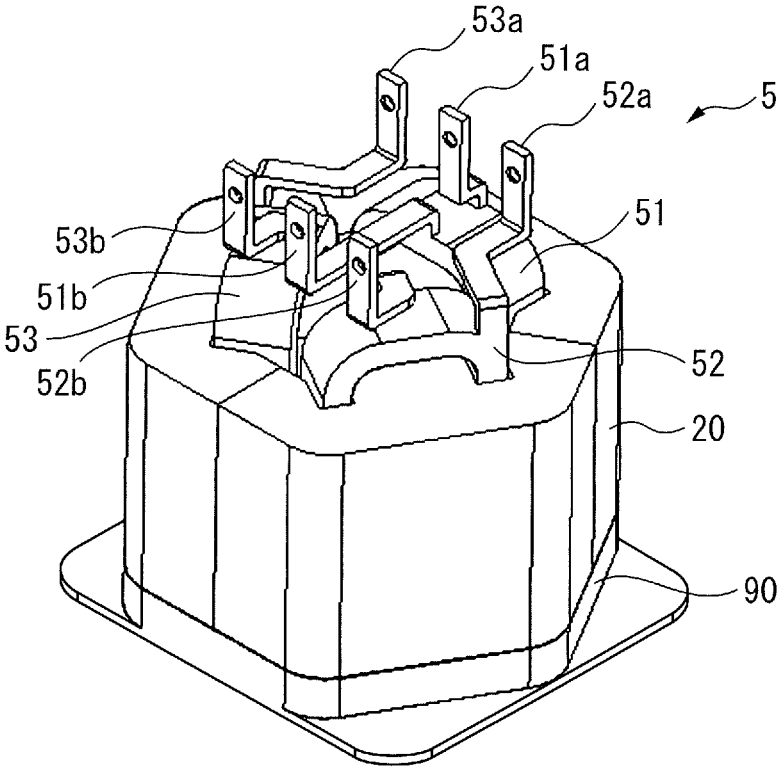
Figure 2B:
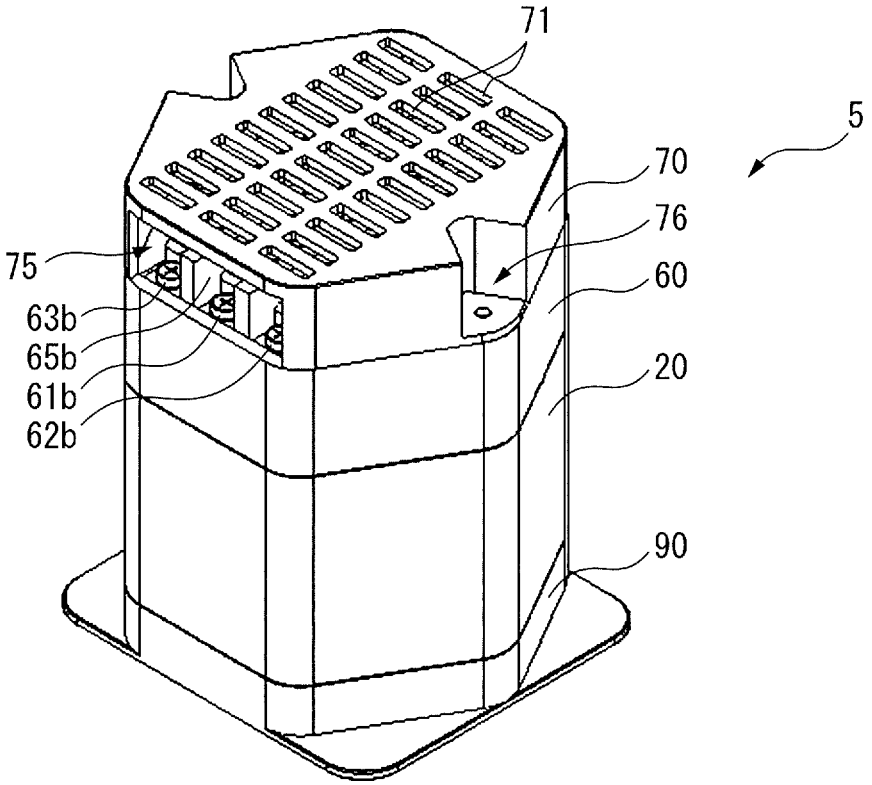
FIG. 2B is a perspective view of the reactor according to the first embodiment.

FIG. 2A is an exploded perspective view of the reactor shown in FIG. 1. FIG. 2B is a perspective view of the reactor according to the first embodiment. As shown in the drawings, an attachment unit 90 having an end plate is attached to a lower end surface of the outer peripheral iron core 20. The attachment unit 90 serves to attach the reactor 5 in a predetermined position.

In FIG. 2A, two leads 51*a* and 51*b* extend from the coil 51. Two leads 52*a* and 52*b* extend from the coil 52. Two leads 53*a* and 53*b* extend from the coil 53. The leads 51*a* to 53*a* are input leads, while the leads 51*b* to 53*b* are output leads. The leads 51*a* to 53*a* and 51*b* to 53*b* are bent independently of each other so as to align the tip ends of the leads 51*a* to 53*a* and align the tip ends of the leads 51*b* to 53*b*. For the purpose of establishing connection to terminals, as described later, the tip ends of the leads 51*a* to 53*a* and 51*b* to 53*b* may be further bent.

A terminal base 60 is illustrated over the outer peripheral iron core 20. The terminal base 60 has an outside shape approximately corresponding to the outer peripheral iron core 20. The height of the terminal base 60 in the axial direction is more than that of each of protruding portions of the coils 51 to 53 from the outer peripheral iron core 20. The terminal base 60 includes input terminals 61*a* to 63*a* to be connected to the input leads 51*a* to 53*a* and output terminals 61*b* to 63*b* to be connected to the output leads 51*b* to 53*b*, respectively, in its top surface. The input terminals 61*a* to 63*a* are arranged along an edge of the top surface of the terminal base 60. The output terminals 61*b* to 63*b* are arranged along another opposite edge. The input terminals 61*a* to 63*a* and the output terminals 61*b* to 63*b* are preferably arranged along the edges, but may be arranged in other positions.

Furthermore, partitions 65*a* and 65*b* are disposed on the top surface of the terminal base 60. The partition 65*a* separates the input terminals 61*a* to 63*a* from the output terminals 61*b* to 63*b*. The partition 65*a* also separates the input terminals 61*a* to 63*a* from each other. In the same manner, the partition 65*b* separates the output terminals 61*b* to 63*b* from the input terminals 61*a* to 63*a*. The partition 65*b* also separates the output terminals 61*b* to 63*b* from each other. Thus, the partitions 65*a* and 65*b* have the same comb shape. The partitions 65*a* and 65*b* are disposed approximately axisymmetrically to each other.

Furthermore, an electric shock prevention cover 70 is illustrated over the terminal base 60. The cover 70 is preferably made of an insulating material. In the first embodiment, the cover 70 has an outside shape approximately corresponding to the outer peripheral iron core 20. In a side surface of the cover 70, cutouts 75 are formed in a position corresponding to the input terminals 61*a* to 63*a* of the terminal base 60, and in a position corresponding to the output terminals 61*b* to 63*b* of the terminal base 60. Furthermore, recessed portions 76 are formed between the two cutouts 75. At least one air vent 71 is formed in the cover 70.

The air vent 71 preferably is sized so that a human finger cannot be inserted therein, according to the degree of protection IP2 of the Japanese Industrial Standards. Alternatively, the air vent 71 preferably is sized so that a human hand cannot be inserted therein, according to the degree of protection IP1 of the Japanese Industrial Standards. This ensures the safety of an operator.

The air vent 71 may be a hole into which only a tool, more specifically, only a probe of the tool can be inserted. The tool, e.g., a tester may contact a terminal through the hole to measure a voltage or the like.

The leads 51*a* to 53*a* of the coils 51 to 53 are connected to the terminals 61*a* to 63*a* of the terminal base 60, respectively. The leads 51*b* to 53*b* of the coils 51 to 53 are connected to the terminals 61*b* to 63*b* of the terminal base 60, respectively. The terminal base 60 is attached to an upper end surface of the outer peripheral iron core 20, and secured with screws or a predetermined jig. After that, the terminals 61*a* to 63*a* and 61*b* to 63*b* are connected to other electrical wires.

Then, the cover 70 is disposed on the upper end surface of the terminal base 60. As shown in FIG. 2A, holes formed in the recessed portions 76 correspond to holes formed in the top surface of the terminal base 60. Screws are screwed into the holes, to secure the cover 70 to the terminal base 60. The terminal base 60 may be secured to the outer peripheral iron core 20 in the same manner. The reactor 5 shown in FIG. 2B is obtained thereby.

In the first embodiment, the cover 70 attached to the terminal base 60 prevents the operator from touching the conductive portions such as the terminals, thus ensuring the safety of the operator. Since the air vents 71 are formed in the cover 70, heat generated from the coils 51 to 53 and the like is dissipated through the air vents 71. Furthermore, the cover 70 is easily secured using the holes formed in the recessed portions 76.

Figure 3:
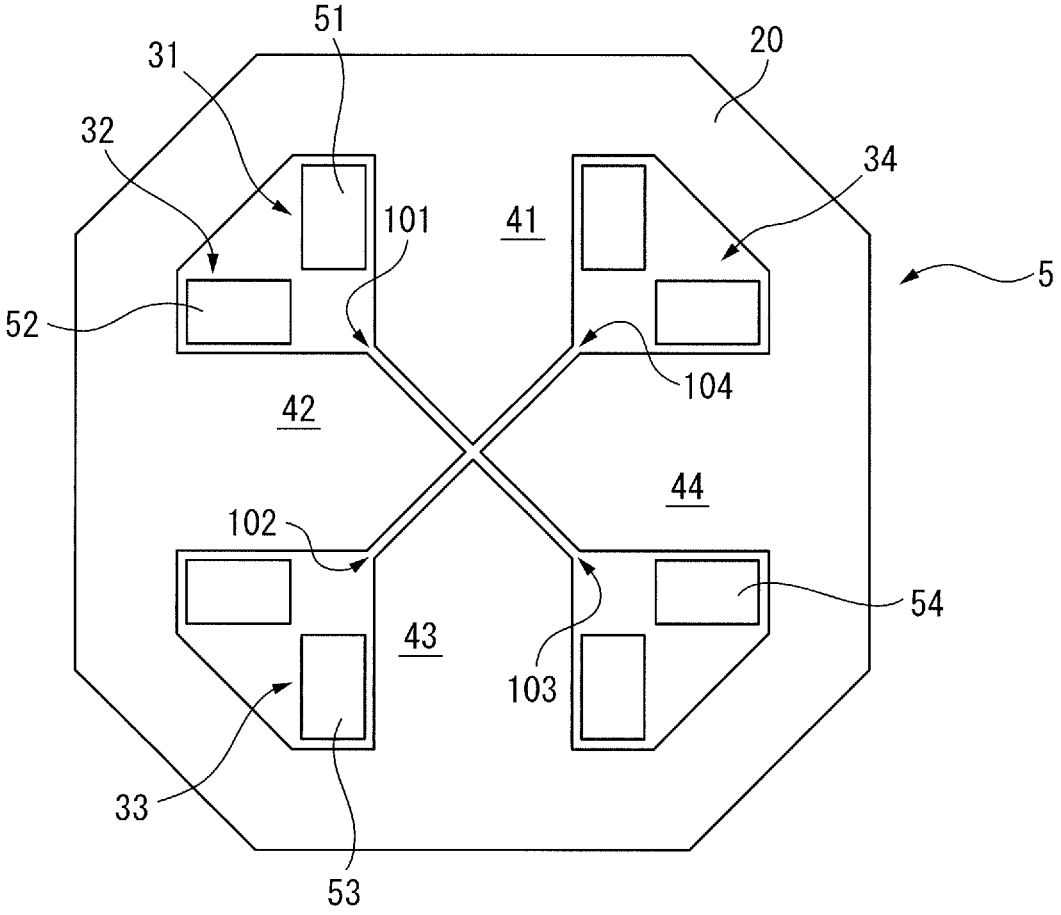
FIG. 3 is a cross-sectional view of a reactor according to a second embodiment.

FIG. 3 is a cross-sectional view of a reactor according to a second embodiment.

In FIG. 3, a reactor 5 includes an approximately octagonal outer peripheral iron core 20 and four core coils 31 to 34, which are similar to the core coils 31 to 33 described above, disposed inside the outer peripheral iron core 20. The core coils 31 to 34 are arranged at approximately equal intervals in the circumferential direction of the reactor 5. The number of cores is preferably an even number more than 4, and the reactor 5 can thereby be used as a single-phase reactor.

As is apparent from the drawing, the core coils 31 to 34 include cores 41 to 44 extending in the radial direction and coils 51 to 54 wound onto the cores 41 to 44, respectively. The cores 41 to 44 are in contact or integral with the outer peripheral iron core 20 at their radial outer end portions.

Furthermore, radial inner end portions of the cores 41 to 44 are disposed in the vicinity of the center of the outer peripheral iron core 20. In FIG. 3, the cores 41 to 44 converge toward the center of the outer peripheral iron core 20 at their radial inner end portions each having an edge angle of approximately 90°. The radial inner end portions of the cores 41 to 44 are separated from each other by gaps 101 to 104, which can be magnetically coupled.

Figure 4:
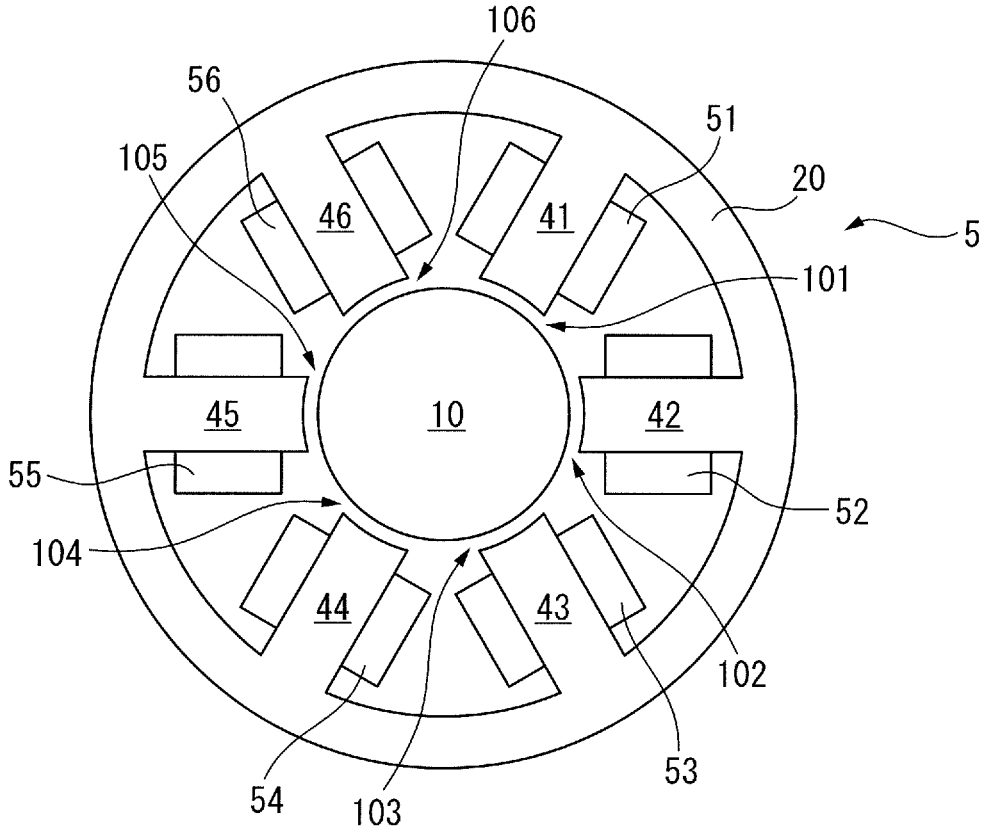
FIG. 4 is a cross-sectional view of a reactor according to a third embodiment.

Furthermore, FIG. 4 is a cross-sectional view of a reactor according to a third embodiment. In FIG. 4, a reactor 5 includes a round outer peripheral iron core 20 and six core coils 31 to 36. The core coils 31 to 36 include cores 41 to 46 and coils 51 to 56 wound onto the cores 41 to 46, respectively. The cores 41 to 46 are in contact or integral with an inner surface of the outer peripheral iron core 20. A central core 10 is disposed at the center of the outer peripheral iron core 20. The central core 10 is formed in the same manner as the outer peripheral iron core 20. Each of gaps 101 to 106, through which magnetic connection can be established, is formed between each of radial inner end portions of the cores 41 to 46 and the central core 10.

A terminal base 60 having the similar structure as described above is attached to one end surface of the outer peripheral iron core having the cores whose number is an even number of 4 or more, as shown in FIG. 3, and the outer peripheral iron core having the central core 10, as shown in FIG. 4, and a cover 70 having the similar structure as described above is further attached thereto. Such a reactor 5 has improved heat dissipation and ensures the safety of an operator for the same reasons as described above.

The reactor 5 having the structure shown in FIG. 1 will be described below in more detail. The following description is generally applicable to the reactors 5 shown in FIGS. 3 and 4.

Figure 5A:
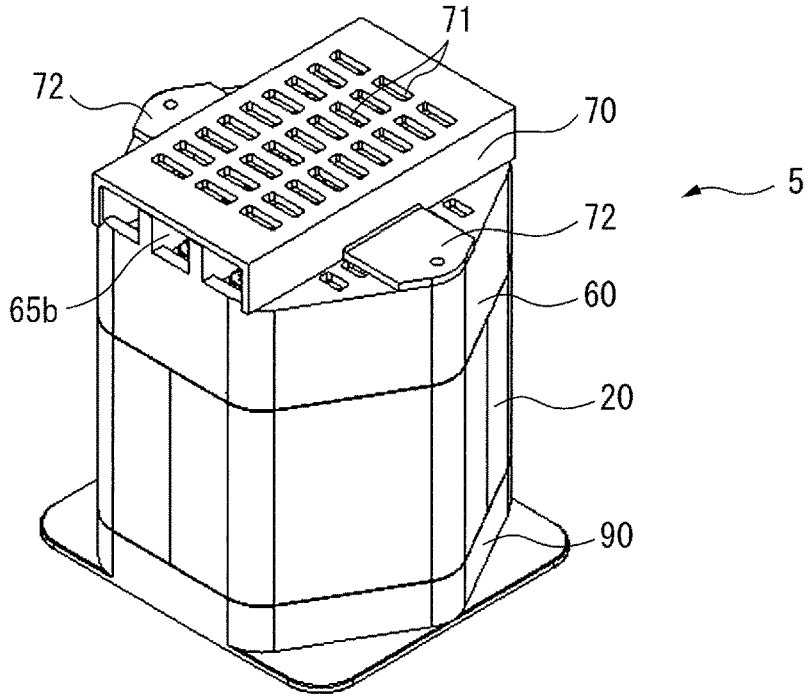
FIG. 5A is a perspective view of a reactor according to a fourth embodiment.
Figure 5B:
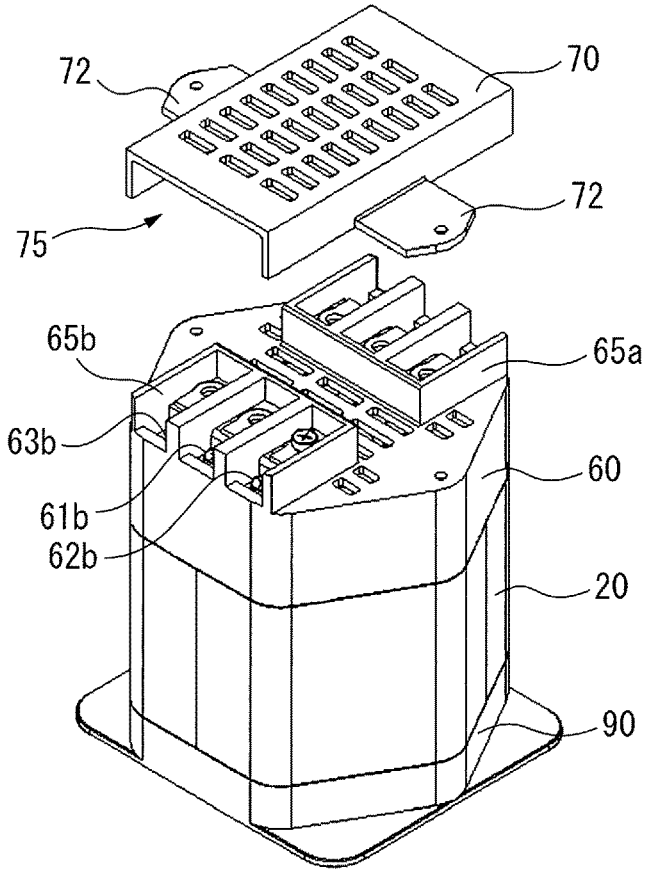
FIG. 5B is an exploded perspective view of the reactor shown in FIG. 5A.

FIG. 5A is a perspective view of a reactor according to a fourth embodiment, and FIG. 5B is an exploded perspective view of the reactor shown in FIG. 5A. In the drawings, only the shape of the cover 70 is different from that of the cover 70 described above.

As described above, partitions 65*a* and 65*b* having the same comb shape are disposed separately from each other. The cover 70 shown in FIG. 5B has a shape corresponding to the partitions 65*a* and 65*b* attached to a terminal base 60. To be more specific, the cover 70 has a rectangular shape so as to enclose the partitions 65*a* and 65*b* and an area between the partitions 65*a* and 65*b*. Thus, the outside shape of the cover 70 corresponds to part of the outside shape of the terminal base 60. The cover 70 has extending portions 72 that extend from both side surfaces of the cover 70 to edge portions of the terminal base 60, instead of having recessed portions 76.

The extending portions 72 have holes formed so as to correspond to holes formed in the top surface of the terminal base 60. In the same manner as described above, screws are screwed into the holes to secure the cover 70 to the terminal base 60. In the fourth embodiment, since air vents 71 are formed in the cover 70, the same effects as described above can be obtained. Furthermore, the cover 70 having an outside shape corresponding to the partitions 65*a* and 65*b* has minimum dimensions, thus allowing reductions in weight and size, as well as a reduction in manufacturing cost.

Figure 6A:
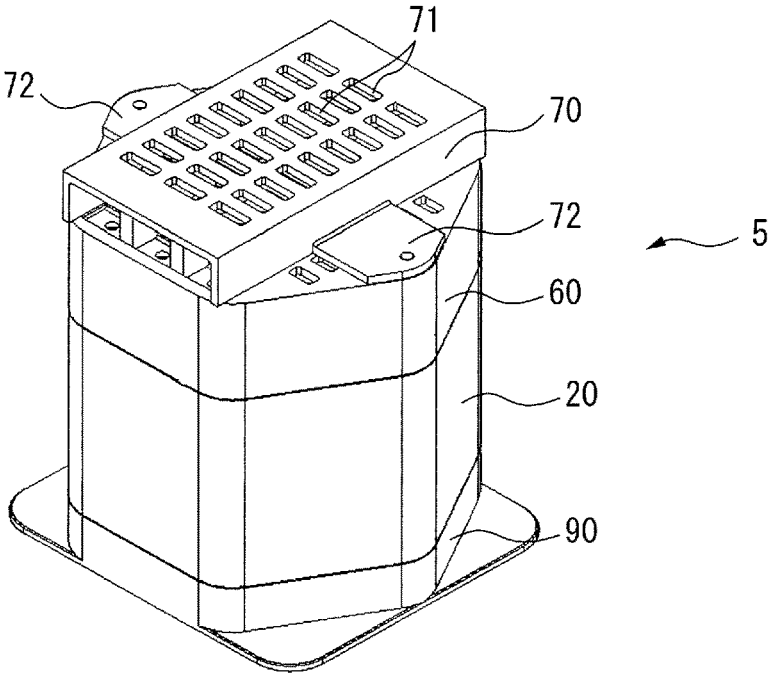
FIG. 6A is a perspective view of a reactor according to a fifth embodiment.
Figure 6B:
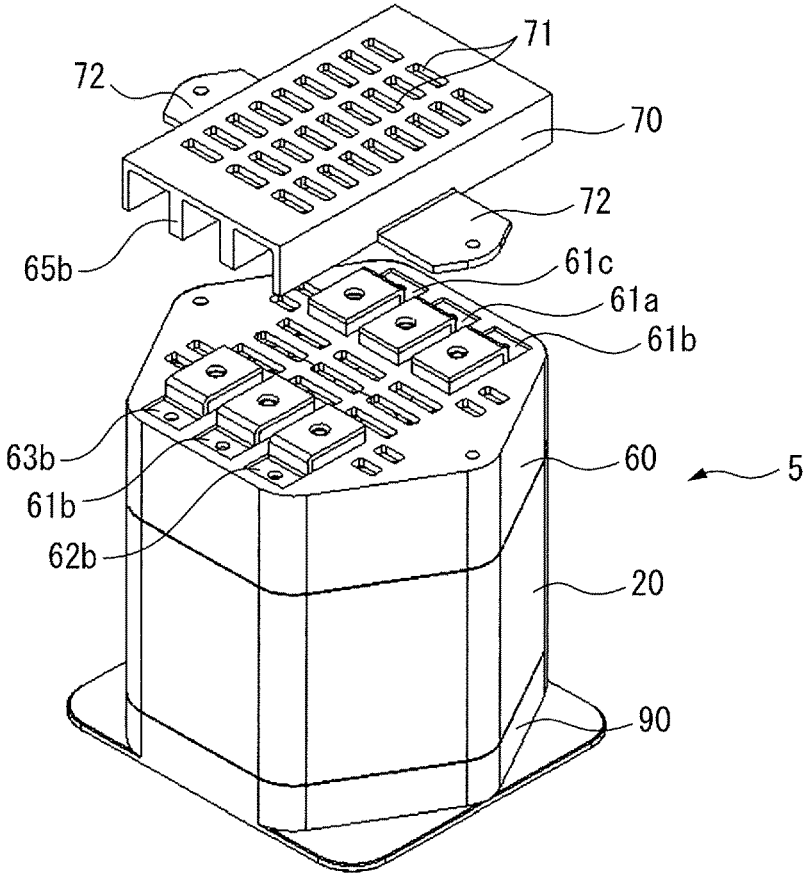
FIG. 6B is an exploded perspective view of the reactor shown in FIG. 6A.

FIG. 6A is a perspective view of a reactor according to a fifth embodiment, and FIG. 6B is an exploded perspective view of the reactor shown in FIG. 6A. A cover 70 shown in the drawings has approximately the same outside shape as the cover 70 shown in FIGS. 5A and 5B. As is apparent from FIG. 6B, partitions 65*a* and 65*b* are not disposed in a top surface of a terminal base 60, but are disposed in a rear surface of the cover 70. The partitions 65*a* and 65*b* may be formed integrally with the cover 70.

In a state of attaching the terminal base 60 to an outer peripheral iron core 20, as shown in FIG. 6B, terminals 61*a* to 63*a* and 61*b* to 63*b* are connected to other electrical wires. Then, the cover 70 having the partitions 65*a* and 65*b* is attached and secured to the terminal base 60, in the same manner as described above. In this case, when the terminals 61*a* to 63*a* and 61*b* to 63*b* are connected to the electrical wires, the partitions 65*a* and 65*b* are absent. Thus, the partitions 65*a* and 65*b* do not interfere with an operator's fingers. Therefore, the operator can easily establish the connection between the terminals 61*a* to 63*a* and 61*b* to 63*b* and the electrical wires. Furthermore, since air vents 71 are formed in the cover 70, the same effects as described above can be obtained.

Figure 7A:
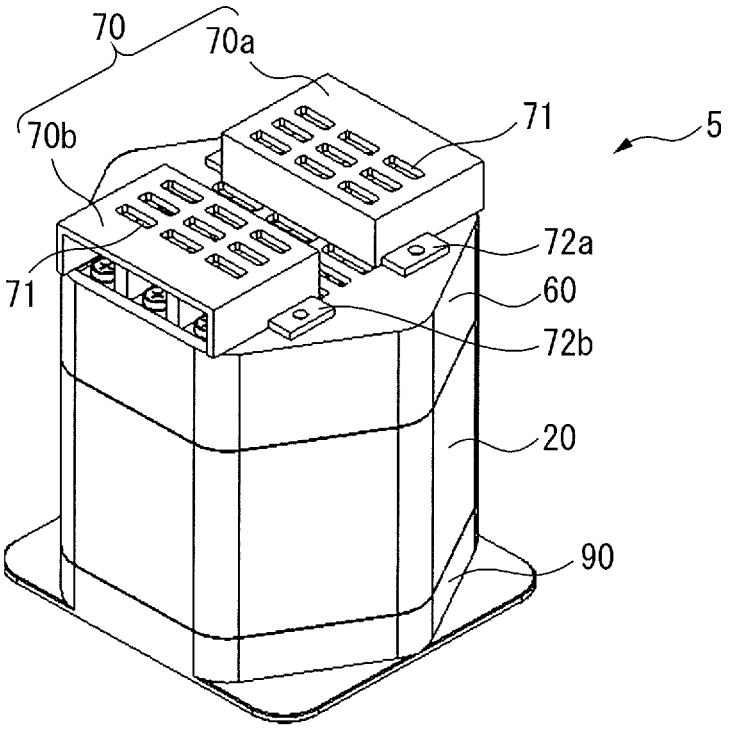
FIG. 7A is a perspective view of a reactor according to a sixth embodiment.
Figure 7B:
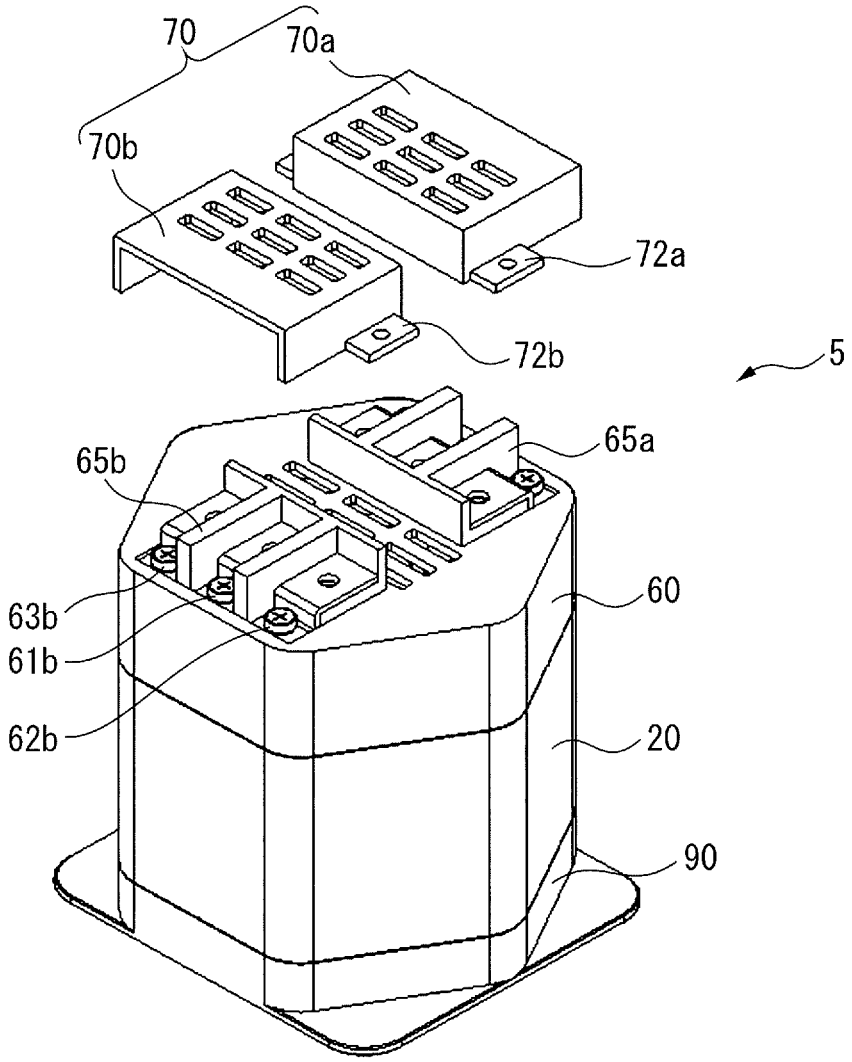
FIG. 7B is an exploded perspective view of the reactor shown in FIG. 7A.

FIG. 7A is a perspective view of a reactor according to a sixth embodiment, and FIG. 7B is an exploded perspective view of the reactor shown in FIG. 7A. A cover 70 shown in the drawings is constituted of a first cover portion 70*a* and a second cover portion 70*b*. The first cover portion 70*a* covers a partition 65*a* and terminals 61*a* to 63*a* on an input side, while the second cover portion 70*b* covers a partition 65*b* and terminals 61*b* to 63*b* on an output side.

The first cover portion 70*a* has extending portions 72*a*, and the second cover portion 70*b* has extending portions 72*b*, in the same manner as described above. The extending portions 72*a* and 72*b* have holes formed so as to correspond to holes formed in a top surface of a terminal base 60. In FIG. 7A, the first cover portion 70*a* and the second cover portion 70*b* are separated from each other by a gap, but the first cover portion 70*a* and the second cover portion 70*b* may be in contact with each other.

After the input terminals 61*a* to 63*a* are connected to other electrical wires, the first cover portion 70*a* covers the partition 65*a* and the terminals 61*a* to 63*a*. The extending portions 72*a* of the first cover portion 70*a* are screwed onto the terminal base 60. Then, the output terminals 61*b* to 63*b* are connected to other electrical wires, and the second cover portion 70*b* covers the partition 65*b* and the terminals 61*b* to 63*b*. The extending portions 72*b* of the second cover portion 70*b* are screwed onto the terminal base 60. Alternatively, while the terminals 61*a* to 63*a* are connected to the electrical wires, the partition 65*b* and the like may be covered with the second cover 70*b* or the like.

As is apparent from FIG. 7B, the first cover portion 70*a* and the second cover portion 70*b* have the same specifications. This prevents an increase in manufacturing cost. Since the input terminals 61*a* to 63*a* and the output terminals 61*b* to 63*b* can be connected separately, a connection operation can be performed easily and safely. Furthermore, since air vents 71 are formed in the first cover portion 70*a* and the second cover portion 70*b*, the same effects as described above can be obtained.

Figure 8A:
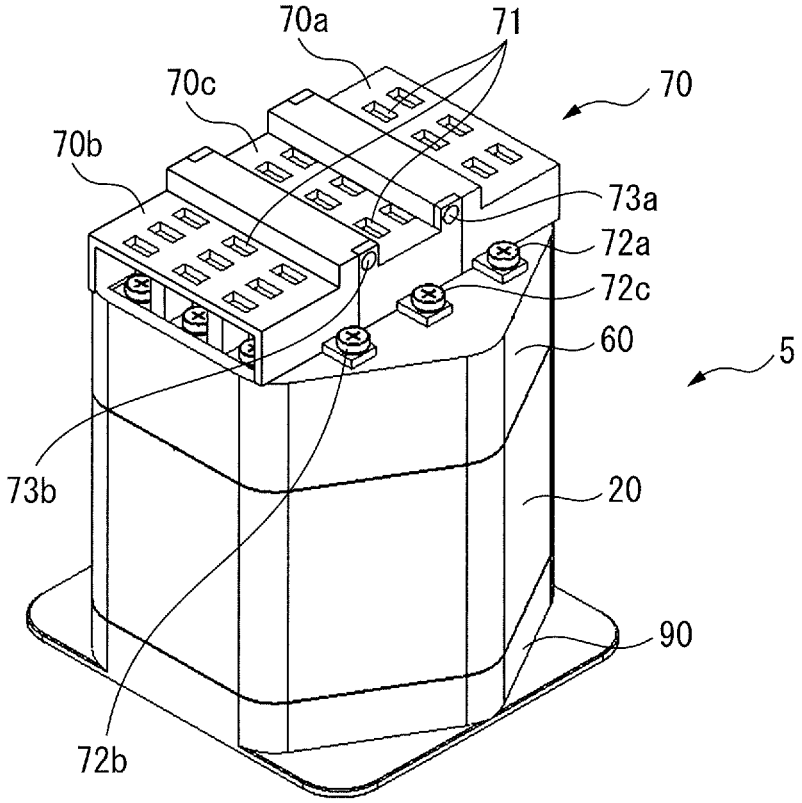
FIG. 8A is a perspective view of a reactor according to a seventh embodiment.
Figure 8B:
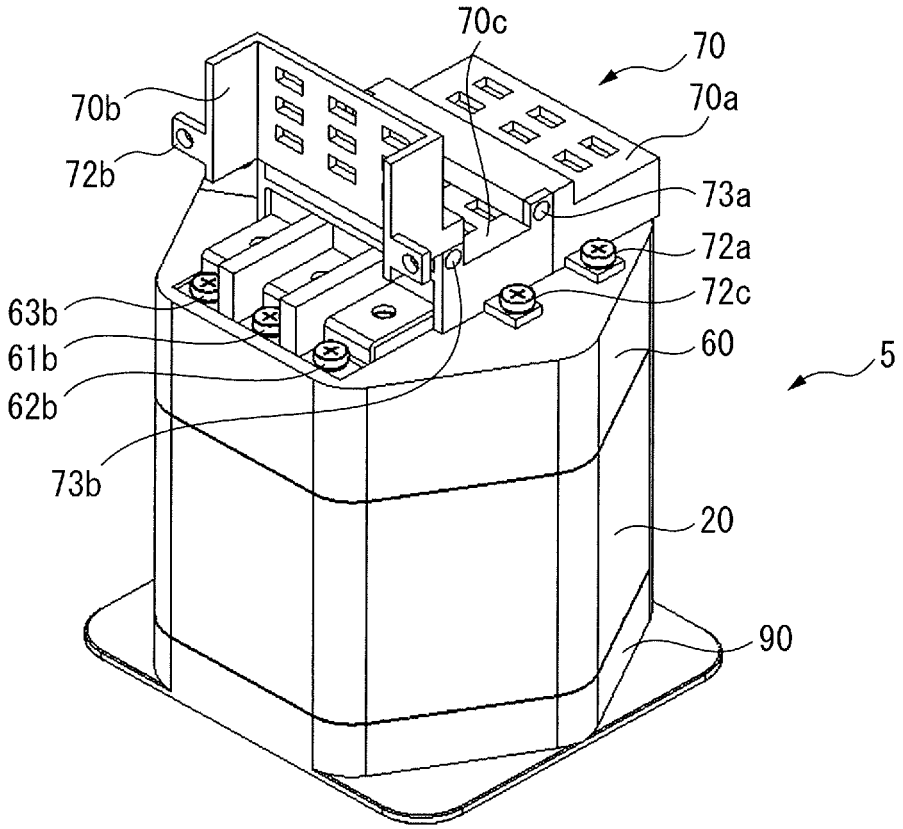
FIG. 8B is another perspective view of the reactor shown in FIG. 8A.

FIG. 8A is a perspective view of a reactor according to a seventh embodiment, and FIG. 8B is another perspective view of the reactor shown in FIG. 8A. A cover 70 shown in the drawings is constituted of a first cover portion 70*a* and a second cover portion 70*b*, which are similar to above, and an additional cover portion 70*c* disposed between the first cover portion 70*a* and the second cover portion 70*b*. The additional cover portion 70*c* is secured to a terminal base 60 using holes formed in extending portions 72*c* in the same manner as described above. In the additional cover portion 70*c*, air vents 71 are formed in the same manner as described above.

As is apparent from FIG. 8B, the first cover portion 70*a* and the second cover portion 70*b* are pivotably connected to the additional cover portion 70*c* by hinged portions 73*a* and 73*b*, respectively. In this case, after a reactor 5 is assembled as shown in FIG. 8A, for example, extending portions 72*b* of the second cover portion 70*b* are unscrewed. Then, as shown in FIG. 8B, only the second cover portion 70*b* is pivoted around the hinged portion 73*b*. This allows an operator to access only the output terminals 61*b* to 63*b*, and establish re-connection and the like. In other words, the re-connection can be established without detaching the second cover portion 70*b* from the terminal base 60. Therefore, it is possible to ensure the safety of the operator, as well as preventing the loss of the second cover portion 70*b*.

Figure 9A:
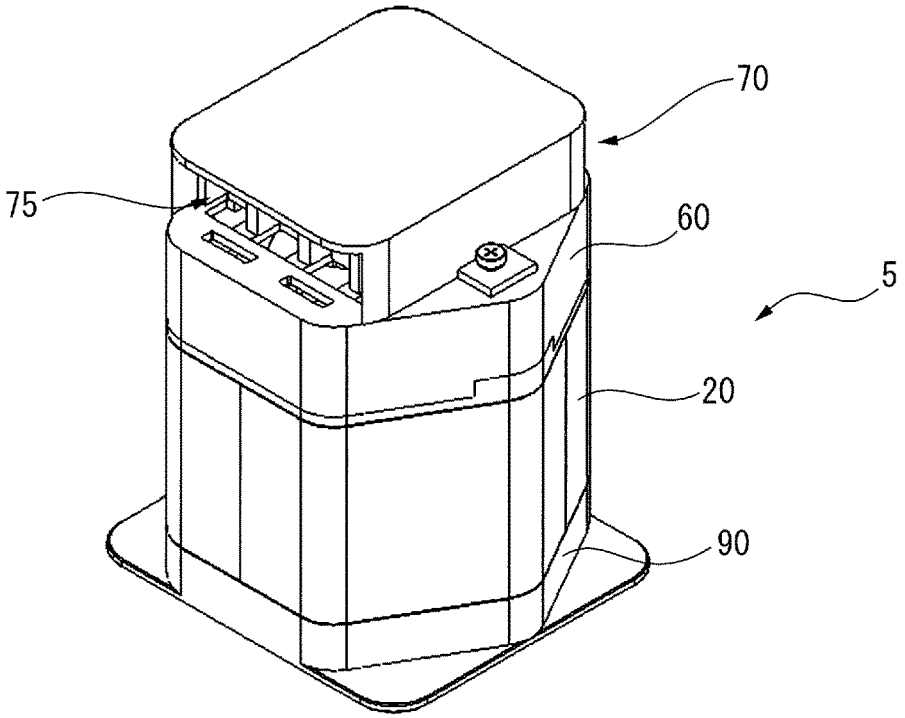
FIG. 9A is a perspective view of a reactor according to an eighth embodiment.
Figure 9B:
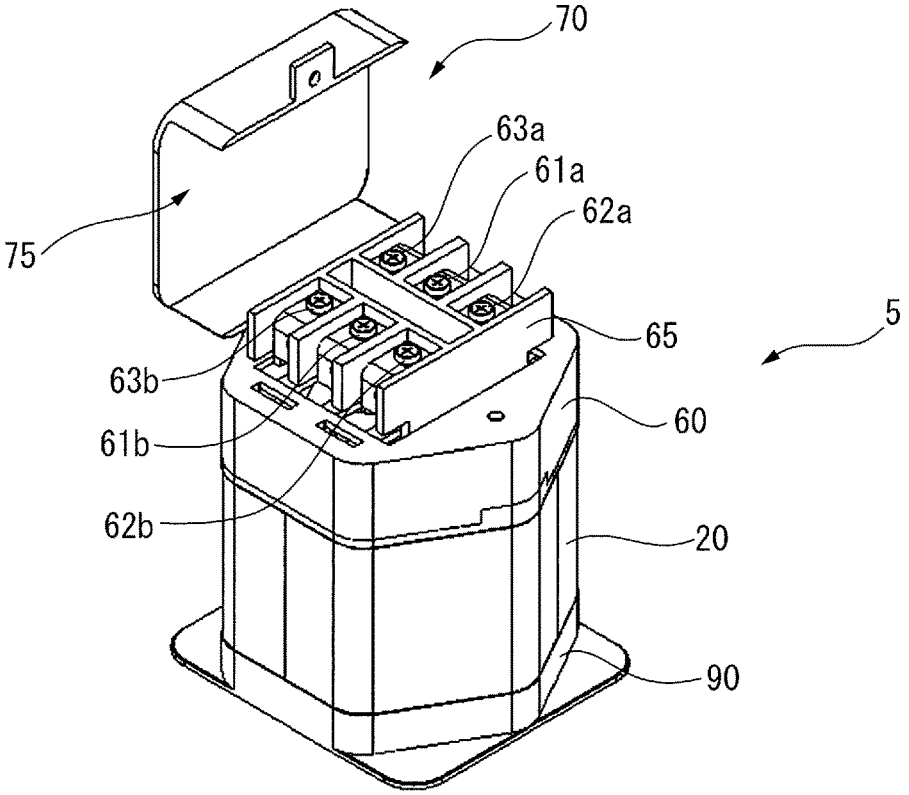
FIG. 9B is another perspective view of the reactor shown in FIG. 9A.

FIG. 9A is a perspective view of a reactor according to an eighth embodiment, and FIG. 9B is another perspective view of the reactor shown in FIG. 9A. In the drawings, a single partition 65 separates terminals 61*a* to 63*a* and 61*b* to 63*b* from each other. A single cover 70 is disposed so as to cover the partition 65 and all of the terminals 61*a* to 63*a* and 61*b* to 63*b* inside the partition 65. Thus, the cover 70 has larger dimensions than the partition 65, and smaller dimensions than a terminal base 60.

Figure 9C:
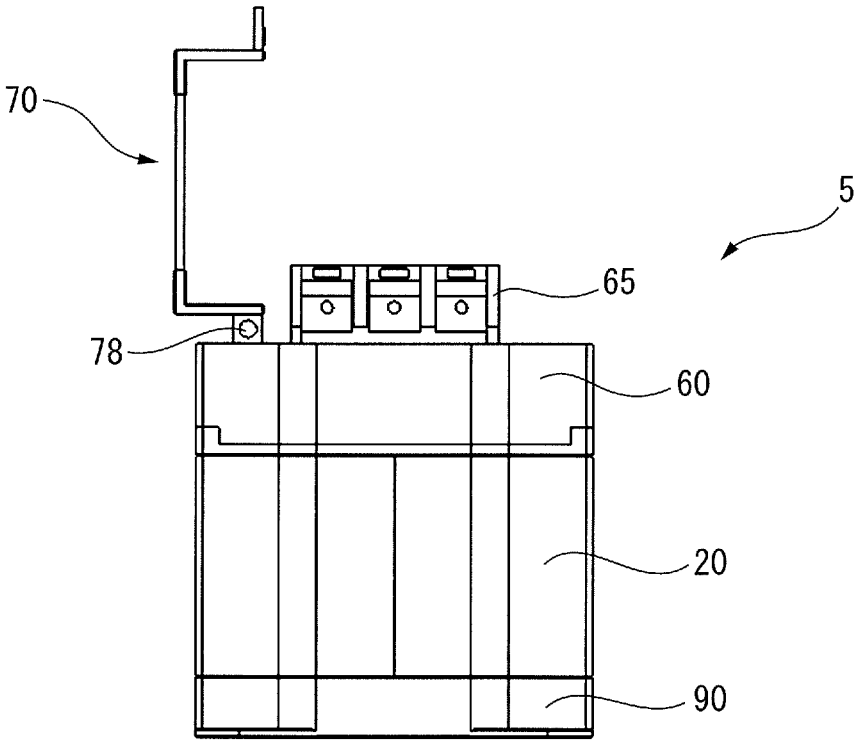
FIG. 9C is a side view of the reactor shown in FIG. 9B.
Figure 9D:
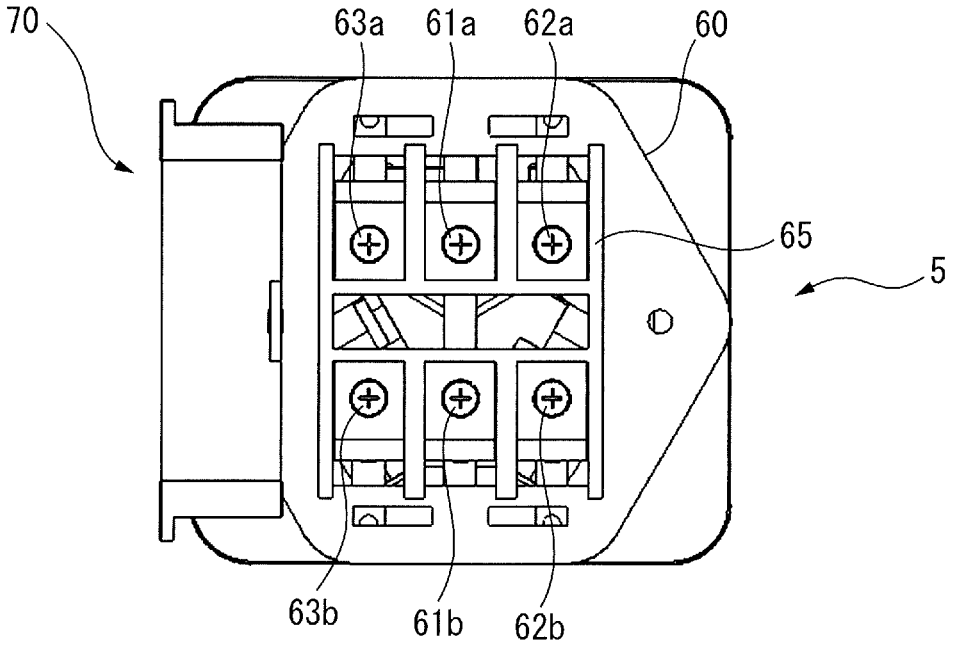
FIG. 9D is a top view of the reactor shown in FIG. 9B.

FIG. 9C is a side view of the reactor shown in FIG. 9B, and FIG. 9D is a top view of the reactor shown in FIG. 9B. The cover 70 is pivotable around a hinged portion 78. By pivoting the single cover 70 around the hinged portion 78, an operator can access the terminals 61*a* to 63*a* and 61*b* to 63*b* without detaching the cover 70. Therefore, the same effects as described above can be obtained.

Figure 10:
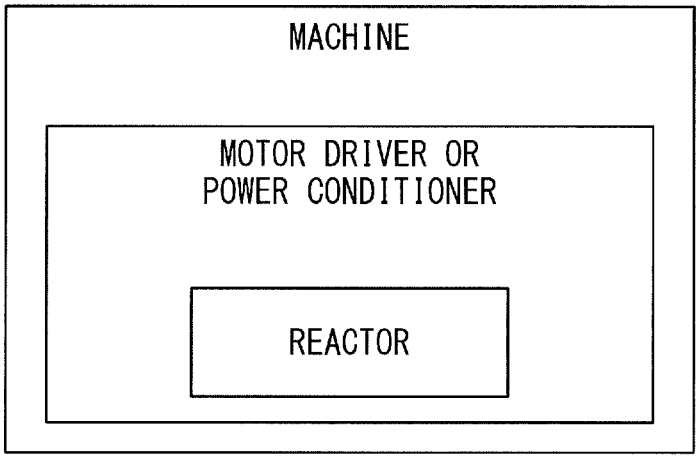
FIG. 10 is a block diagram of a machine including a reactor.

FIG. 10 is a block diagram of a machine including a reactor. In FIG. 10, a reactor 5 is used in a motor driver or a power conditioner. The machine includes the motor driver or the power conditioner. In this case, the motor driver, power conditioner, machine, or the like having the reactor 5 can be easily provided. The scope of the present invention includes appropriate combinations of some of the above-described embodiments.

Aspects of Disclosure

A first aspect provides a reactor (5) that includes an outer peripheral iron core (20), and at least three core coils (31-36) disposed inside the outer peripheral iron core. Each of the core coils includes a core (41-46) and a coil (51-56) wound onto the core. The reactor further includes a terminal base (60) that has a plurality of terminals (61*a*-63*a*, 61*b*-63*b*) connected to leads (51*a*-53*a*, 51*b*-53*b*) extending from the coils and is disposed on one end of the outer peripheral iron core, and an electric shock prevention cover (70) for covering the terminals of the terminal base.

According to a second aspect, in the first aspect, a hole through which a tool can be inserted is formed in the electric shock prevention cover.

According to a third aspect, in the first or second aspect, an air vent is formed in the electric shock prevention cover.

According to a fourth embodiment, in the third aspect, the air vent is sized so that a human finger cannot be inserted therein.

According to a fifth aspect, in the third aspect, the air vent is sized so that a human hand cannot be inserted therein.

According to a sixth aspect, in any one of the first to fifth aspects, a partition (65*a*, 65*b*) for separating the terminals from each other is disposed in the terminal base, and the electric shock prevention cover has an outside shape corresponding to the partition.

According to a seventh aspect, in the first aspect, a partition for separating the terminals from each other is disposed in a rear surface of the electric shock prevention cover.

According to an eighth aspect, a part of the electric shock prevention cover is formed in an openable and closable manner with respect to the remaining part.

According to a ninth aspect, in any one of the first to eighth aspects, the electric shock prevention cover includes a first cover portion (70*a*) for covering an input terminal of the terminals, and a second cover portion (70*b*) for covering an output terminal of the terminals.

A tenth aspect provides a motor driver including the reactor according to any one of the first to ninth aspects.

An eleventh aspect provides a machine including the motor driver according to the tenth aspect.

A twelfth aspect provides a power conditioner including the reactor according to any one of the first to ninth aspects.

A thirteenth aspect provides a machine including the power conditioner according to the twelfth embodiment.

Advantageous Effects of the Aspects

According to the first aspect, the cover attached to the terminal base prevents an operator from touching the terminals, thus ensuring the safety of the operator.

According to the second aspect, the tool, e.g., a tester can be inserted into the hole, and a voltage or the like can be measured without detaching the cover.

According to the third aspect, the air vent facilitates heat dissipation.

According to the fourth aspect, the air vent into which the human finger cannot be inserted ensures the safety of the operator. The dimensions of the air vent are preferably in conformity with the degree of protection IP2 of Japanese Industrial Standards.

According to the fifth aspect, the air vent into which the human hand cannot be inserted ensures the safety of the operator. The dimensions of the air vent are preferably in conformity with the degree of protection IP1 of Japanese Industrial Standards.

According to the sixth aspect, the cover having an outside shape corresponding to the partition has minimum dimensions, thus allowing reductions in weight and size, as well as a reduction in manufacturing cost.

According to the seventh aspect, since the partition is disposed in the rear surface of the cover, the connection of the terminals can be easily established.

According to the eighth aspect, since the re-connection of the terminal can be established without detaching a part of the cover from the terminal base, the part of the cover is prevented from being lost.

According to the ninth aspect, the first cover portion and the second cover portion that may have the same specifications prevent an increase in manufacturing cost. Furthermore, since the input terminals and the output terminals can be separately connected to electrical wires, a connection operation can be performed easily and safely.

According to the tenth to thirteenth aspects, the motor driver, power conditioner, and machine having the reactor can be easily provided.

The present invention is described above with reference to the preferred embodiments, but it is apparent for those skilled in the art that the above modifications and other various modifications, omissions, and additions can be performed without departing from the scope of the present invention.

What is claimed is:

1. A reactor comprising:

an outer peripheral iron core;

at least three core coils disposed inside the outer peripheral iron core, each of the core coils including a core and a coil wound onto the core such that each of the cores is in contact or integral with the outer peripheral iron core and each of the cores is separated from each other by a gap extending from each of the cores into center of the outer peripheral iron core;

a terminal base having a plurality of terminals connected to leads extending from the coils, the terminal base having an outside shape corresponding to the outer peripheral iron core such that the terminal base is disposed on one end of the outer peripheral iron core; and an electric shock prevention cover for covering the terminals of the terminal base, wherein the electric shock prevention cover is disposed on an end surface of the terminal base opposite the outer peripheral core.

2. The reactor according to claim 1, wherein a hole is formed in the electric shock prevention cover.

3. The reactor according to claim 1, wherein an air vent is formed in the electric shock prevention cover.

4. The reactor according to claim 3, wherein the air vent is sized to prevent a human finger from being inserted therein.

5. The reactor according to claim 3, wherein the air vent is sized to prevent a human hand from being inserted therein.

6. The reactor according to claim 1, wherein a partition for separating the terminals from each other is disposed in the terminal base, and the electric shock prevention cover has an outside shape corresponding to the partition.

7. The reactor according to claim 1, wherein a partition for separating the terminals from each other is disposed in a rear surface of the electric shock prevention cover.

8. The reactor according to claim 1, wherein a part of the electric shock prevention cover is formed in an openable and closable manner with respect to the remaining part.

9. The reactor according to claim 1, wherein the electric shock prevention cover includes a first cover portion for covering an input terminal of the terminals, and a second cover portion for covering an output terminal of the terminals.

10. A motor driver comprising the reactor according to claim 1.

11. A machine comprising the motor driver according to claim 10.

12. A power conditioner comprising the reactor according to claim 1.

13. A machine comprising the power conditioner according to claim 12.

* * * * *